US007014544B2

(12) United States Patent
Huang

(10) Patent No.: US 7,014,544 B2
(45) Date of Patent: Mar. 21, 2006

(54) RECIPROCATING AND DEFLECTING SWING DEVICE FOR THE ROLLER OF A CYLINDRICAL EMERY-POLISHING MACHINE

(75) Inventor: Alan Huang, Taichung (TW)

(73) Assignee: WMH Tool Group Hong Kong Limited, Taichung (TW)

( * ) Notice: Subject to any disclaimer, the term of this patent is extended or adjusted under 35 U.S.C. 154(b) by 0 days.

(21) Appl. No.: 10/873,259

(22) Filed: Jun. 23, 2004

(65) Prior Publication Data

US 2005/0287935 A1 Dec. 29, 2005

(51) Int. Cl.
*B24B 7/00* (2006.01)

(52) U.S. Cl. ..... 451/124; 451/120; 451/130; 451/167; 451/184; 451/139

(58) Field of Classification Search ..... 451/11.9, 451/120, 124, 130, 150, 155, 167, 184, 168, 451/300, 309, 310, 424, 425
See application file for complete search history.

(56) References Cited

U.S. PATENT DOCUMENTS

| | | | | |
|---|---|---|---|---|
| 4,746,074 | A * | 5/1988 | Wistuba et al. | 241/101.2 |
| 4,939,870 | A * | 7/1990 | Wang | 451/296 |
| 6,299,512 | B1 * | 10/2001 | Costa et al. | 451/59 |
| 6,471,568 | B1 * | 10/2002 | Wang | 451/168 |
| 6,722,966 | B1 * | 4/2004 | Wang | 451/304 |
| 6,881,136 | B1 * | 4/2005 | Chuang | 451/304 |

* cited by examiner

*Primary Examiner*—Eileen P. Morgan
(74) *Attorney, Agent, or Firm*—Troxell Law Office, PLLC

(57) ABSTRACT

A reciprocating and deflecting swing device for the roller of a cylindrical emery-polishing machine includes a motor fixing base having its inner side provided with a lower holder engaged thereon with an upper holder, with an emery-tape roller fitted in the upper holder. A shaft-coupling unit is connected between the shaft of a motor and the emery-tape roller. A speed-reducing device is installed with the motor fixing base, having an input terminal connected to the shaft-coupling unit by a belt. A rod-connecting unit is pivotally provided between the speed-reducing device and the upper holder. Power of the motor is transmitted to the emery-tape roller and the speed-reducing device respectively by the shaft-coupling unit and the belt. The rod-connecting unit is driven to actuate the upper holder and the emery-tape roller to swing to and fro biasly.

4 Claims, 8 Drawing Sheets

RECIPROCATING AND DEFLECTING SWING DEVICE FOR THE ROLLER OF A CYLINDRICAL EMERY-POLISHING MACHINE

BACKGROUND OF THE INVENTION

1. Field of the Invention

This invention relates to a cylindrical emery-polishing machine, particularly to one having its emery-tape roller provided with a reciprocating and deflecting swing device, able to carry out abrading a wooden work smoothly and prevent the emery-tape roller from being deadlocked.

2. Description of the Prior Art

A conventional emery-polishing machine 10, as shown in FIG. 1, includes a machine base 11 provided with a conveyer 12 on the top side and a motor fixing base 13 at one side. The motor fixing base 13 has its outer side installed with a motor 14 and its inner side fixed with a roller holder 15 positioned above the conveyer 12. The roller holder 15 is axially fitted inside with an emery-tape roller 16 having one end connected with the shaft 141 of the motor 14 to let the motor 14 drive the emery-tape roller 16 to rotate. In using, a wooden work is placed on the conveyer 12 to be carried forward to pass under the emery-tape roller 16 to be abraded.

Although having a function of abrading, the conventional emery-polishing machine 10 still has some defects as described below.

1. The emery-tape roller 16 is unable to swing to and fro biasly; therefore, when abraded, a wooden work is likely to have its abraded portion concentrated on a certain part of the emery-tape roller 16, resulting in quick wear to a part of the emery-tape roller 16, which frequently contacts with a wood work being abraded, and hence shortening the service life of the emery-tape roller 16.

2. The emery-tape roller 16 is unable to swing to and fro biasly; therefore, during abrading, it is easy to let wood dust accumulated and adhered to a certain contacting part of the emery-tape roller 16, thus lowering abrading effect and possible to cause dead lock between the emery-tape roller 16 and the wood work being abraded.

3. In a process of abrading, a wooden piece can only be abraded in forward and backward directions but cannot be abraded in sideward directions; therefore, after abraded, the transverse surface of the wooden work is still uneven, unable to have the whole surface of a wooden work abraded smoothly.

SUMMARY OF THE INVENTION

The objective of the invention is to offer a reciprocating and deflecting swing device for the roller of a cylindrical emery-polishing machine, provided with a motor fixing base having its inner side extending outward to form a lower holder transversely engaged thereon with an upper holder together to form a roller holder, with an emery-tape roller axially fitted between the opposite ends of the upper holder. A shaft-coupling unit is connected between the shaft of a motor and the emery-tape roller. A speed-reducing device is installed at the inner side of the motor fixing base and a belt is connected between the input terminal of the speed-reducing device and the shaft-coupling unit for transmitting power. A rod-connecting unit is pivotally provided between the output terminal of the speed-reducing device and the upper holder. Thus, the power output by the motor can be transmitted by the shaft-coupling unit to drive the emery-tape roller to rotate and then transmitted to the speededucing device by the belt. After rotating speed is reduced, the rod-connecting unit is driven to actuate the upper holder together with the emery-tape roller to swing to and fro biasly.

The reciprocating and deflecting swing device enables the emery-tape roller to regularly swing to and fro biasly so the whole surface of a wooden work can be abraded smoothly. In addition, as the contacting and abrading area of the emery-tape roller with the wooden work is enlarged, the force of abrasion can be evenly imposed upon the emery-tape roller, able to prolong the service life of the emery-tape roller and elevate abrading effect. Moreover, in a abrading process, the emery-tape roller is able to swing to and fro biasly; therefore, wood dust produced during abrading is not easy to be accumulated or adhered to a certain part of the emery-tape roller, able to avoid deadlocking between the emery-tape roller and the wood work being abraded to prolong the service of the emery-tape roller.

BRIEF DESCRIPTION DRAWINGS

This invention will be better understood by referring to the accompanying drawings, wherein.

DETAILED DESCRIPTION OF THE PREFERRED EMBODIMENT

Figure 1:
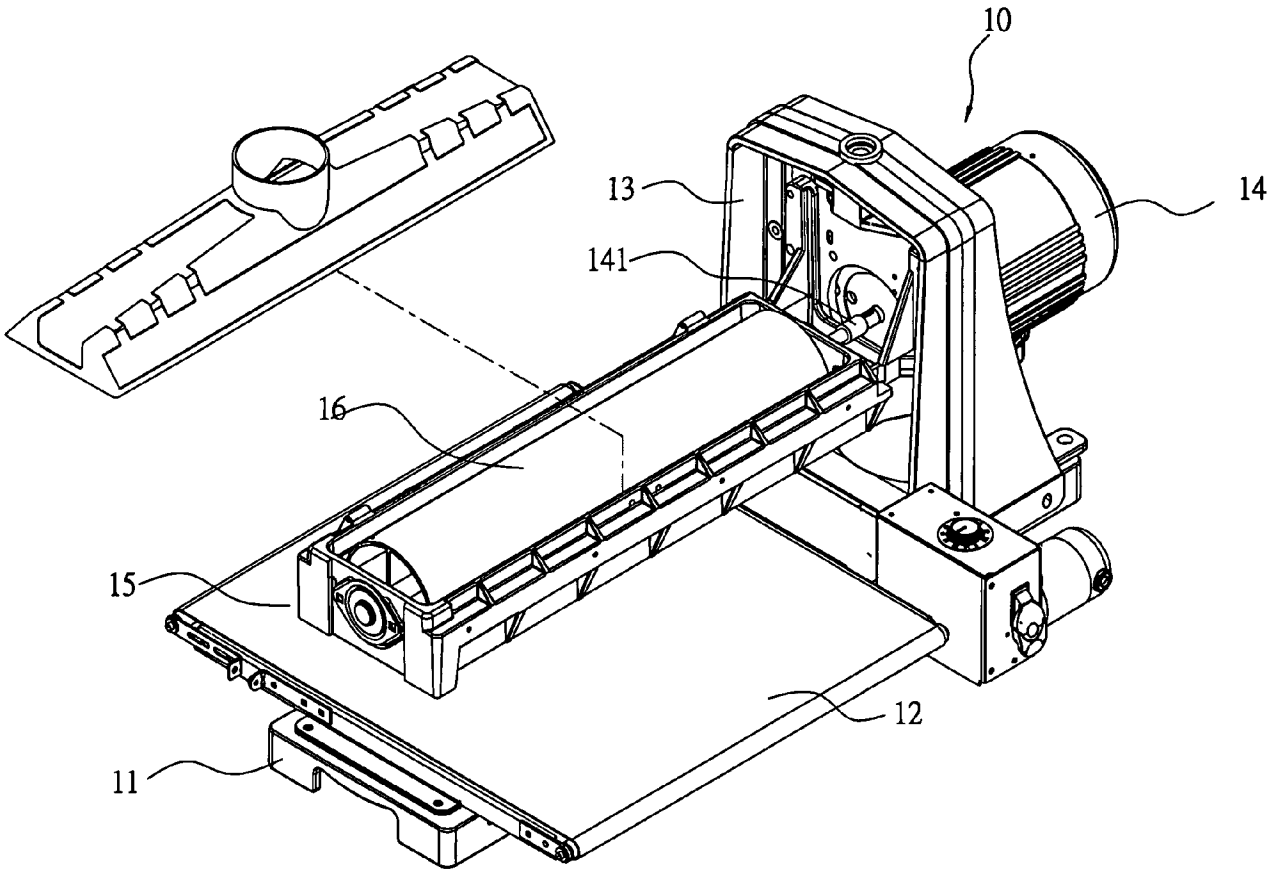
FIG. 1 PRIOR ART
FIG. 1 is a perspective view of a conventional emery-polishing machine.
Figure 2:
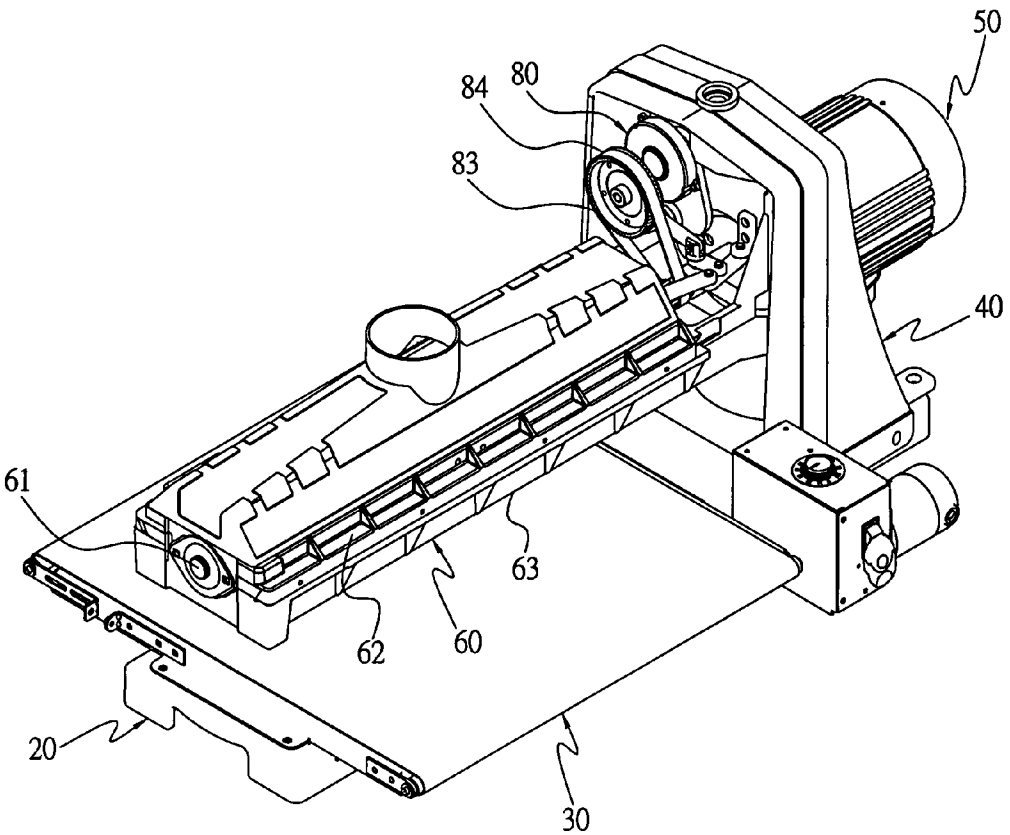
FIG. 2 is a perspective view of an emery-polishing machine in the present invention.
Figure 3:
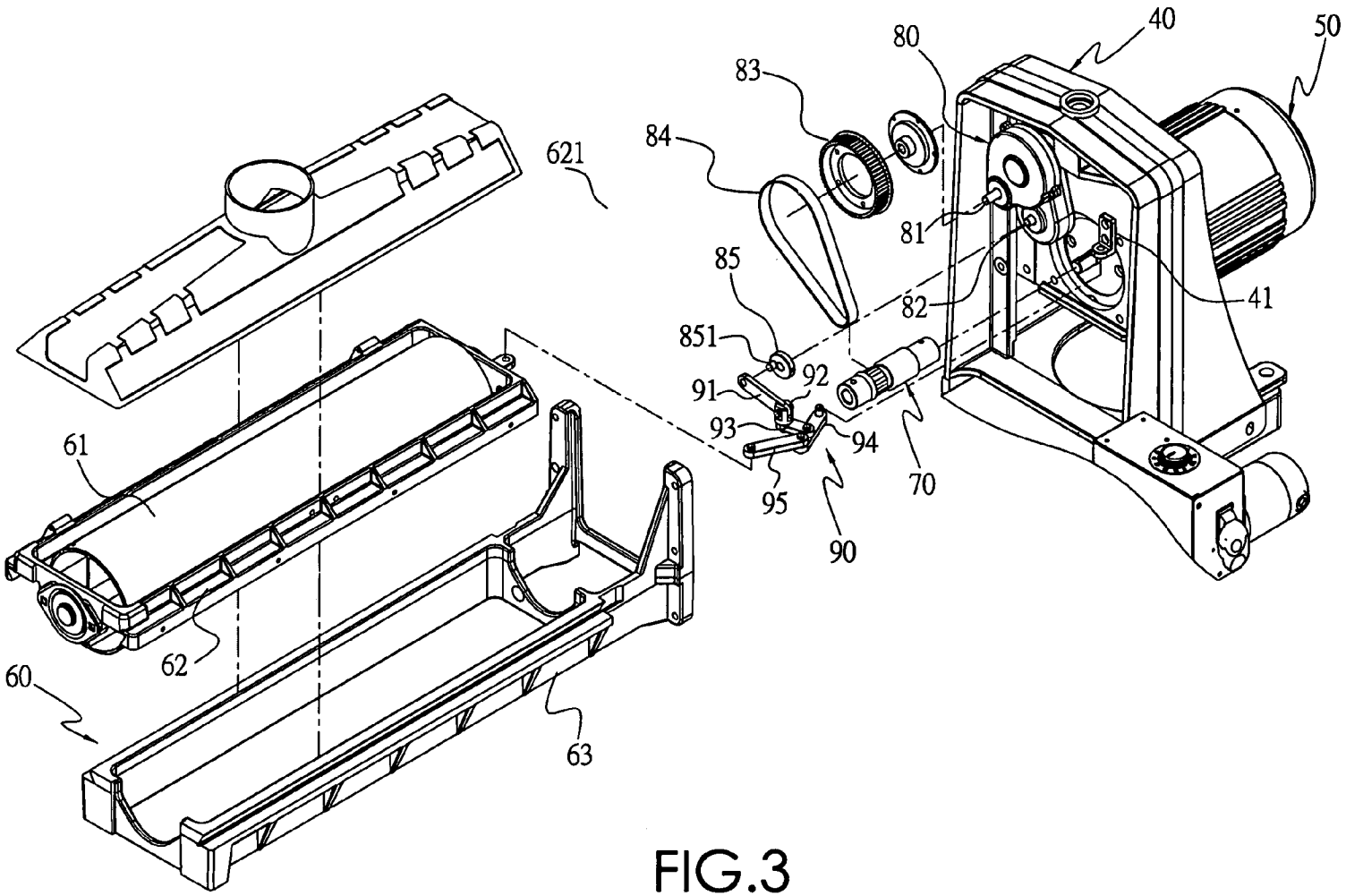
FIG. 3 is a partial exploded perspective view of the emery-polishing machine in the present invention.
Figure 4:
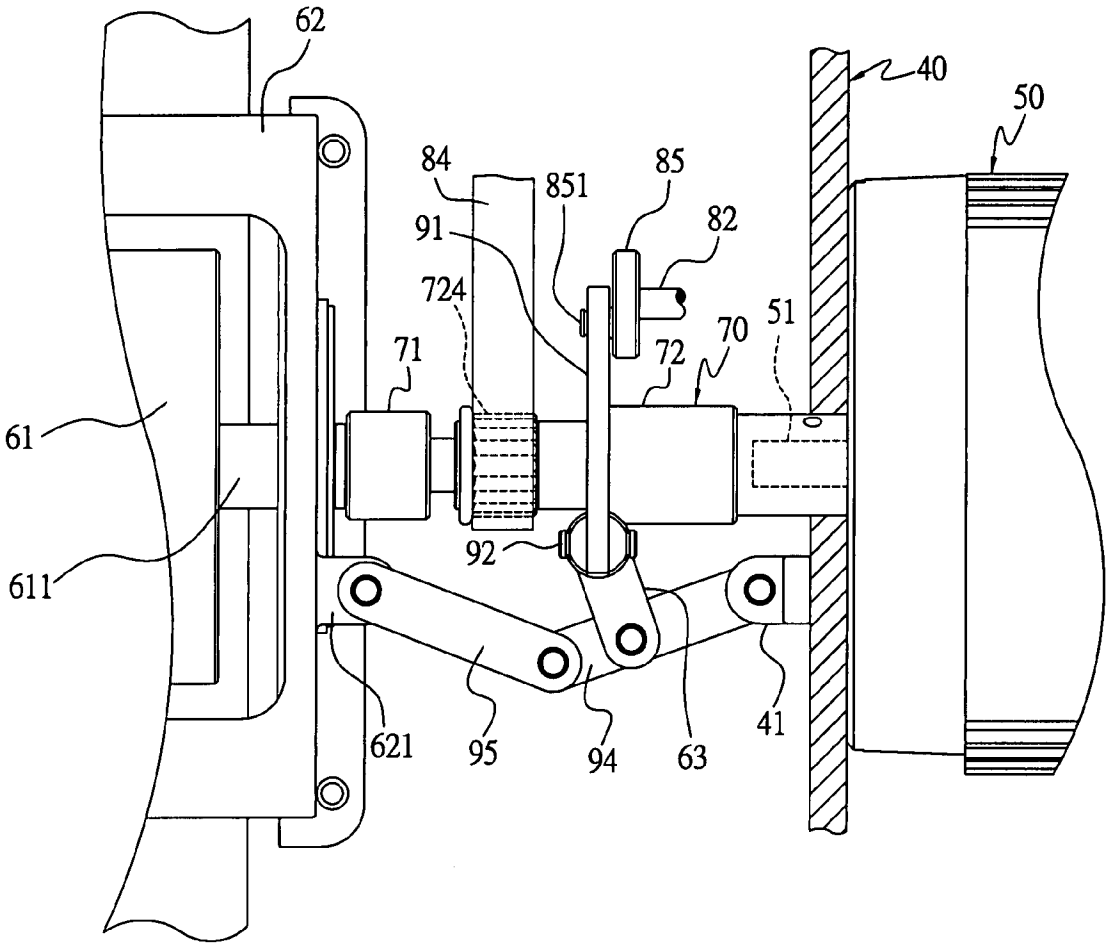
FIG. 4 is an upper view of the rod-connecting unit and the shaft-coupling unit of the emery-polishing machine in the present invention.

A preferred embodiment of a reciprocating and deflecting swing device for the roller of a cylindrical emery-polish machine in the present invention, as shown in FIGS. 2, 3 and 4, includes a machine base 20, a conveyer 30, a motor-fixing base 40, a motor 50, a roller holder 60, a shaft-coupling unit 70, a speed-reducing device 80 and a rod-connecting unit 90 combined together.

The machine base 20 has its topside provided with the conveyer 30 and one side secured with the motor fixing base 40 having its outer side installed with the motor 50 and its inner side provided with the roller holder 60 positioned above the conveyer 30. The roller holder 60 has an emery-tape roller 61 axially fitted in the interior to be driven to rotate by the motor 50.

The motor fixing base 40 has a pivotal lug 41 secured at a preset portion of its inner side.

The roller holder 60 is composed of an upper holder 62 and a lower holder 63. Having the inner wall of the motor fixing base 40 extending outward transversely forms the lower holder 63. The upper holder 62 is transversely engaged and positioned on the lower holder 63, with the emery-tape roller 61 axially fitted between its opposite ends. The upper holder 62 has one end provided with a pivotal lug 621 protruding outward and facing the motor fixing base 40.

Figure 5:
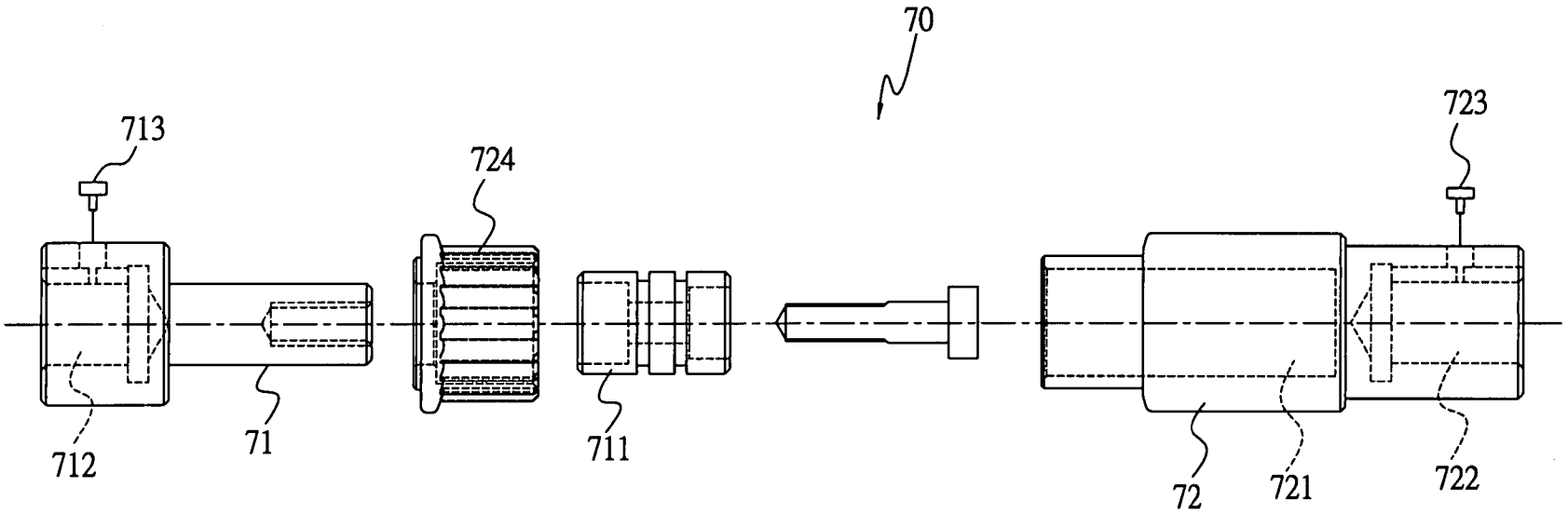
FIG. 5 is an exploded side view of the shaft-coupling unit of the emery-polishing machine in the present invention.
Figure 6:
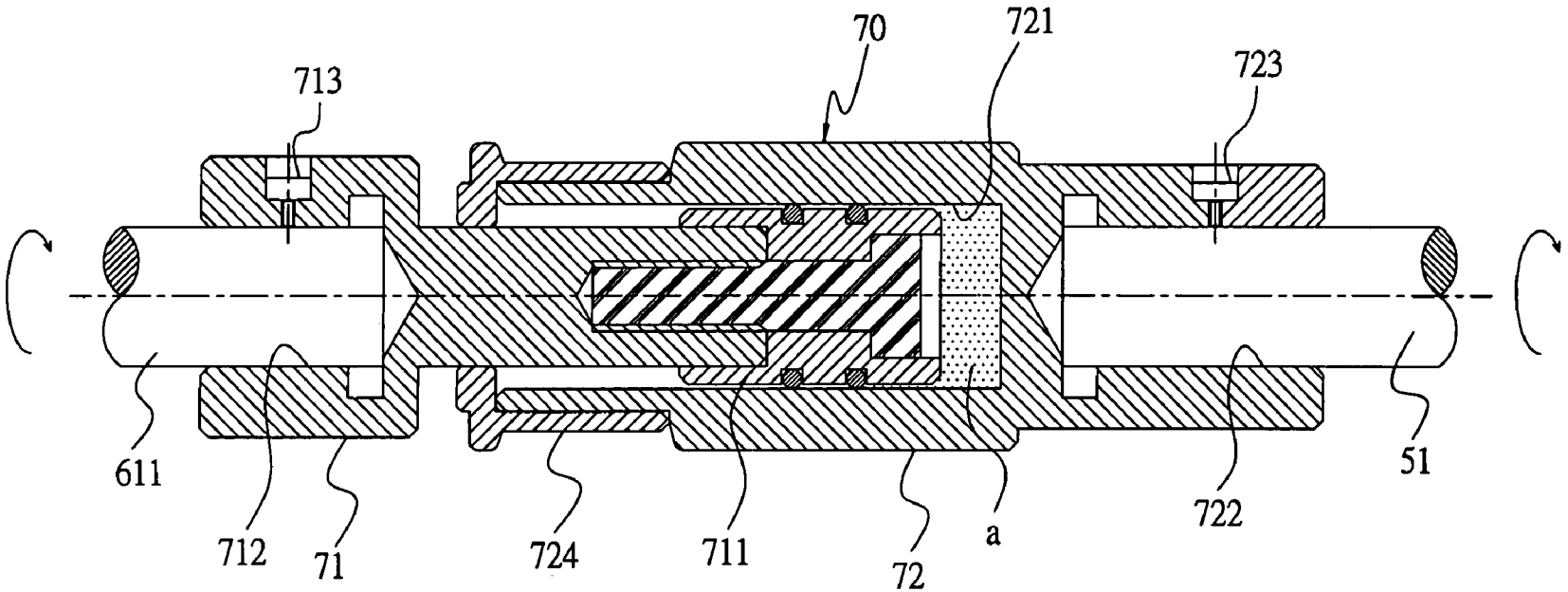
FIG. 6 is a side cross-sectional view of the shaft-coupling unit of the emery-polishing machine in the present invention.

The shaft-coupling unit 70, as shown in FIGS. 5 and 6, consists of a first shaft-coupling member 71 and a second shaft-coupling member 72. The first shaft-coupling member 71 has one end fixed with a piston 711, and the second shaft-coupling member 72 has one end provided with a gas chamber 721 to be closely clogged by the piston 711 of the first shaft-coupling member 71. Further, the second shaft-coupling member 72 has the gas chamber 721 poured therein with a proper amount of nitrogen (a) so as to enable the first and the second shaft coupling member 71, 72 to be pulled outward or pushed inward for a certain distance and timely produce a buffer pulling or pushing force. Furthermore, the first and the second shaft-coupling member 71, 72 have their free ends respectively bored with a shaft hole 712, 722 for the shaft 611 of the emery-tape roller 61 and the shaft 51 of the motor 50 to be respectively inserted therein and fixed in positioned by a locking bolt 713, 723. The second shaft-coupling member 72 is also fitted with a belt pulley 724 at one end facing the first shaft-coupling member 71.

The speed-reducing device 80 is fixed at a preset portion of the inner side of the motor fixing base 40, having a power input terminal 81 and a power output terminal 82. The power input terminal 81 has a time-marking belt pulley 83 fitted thereon to be connected to the belt pulley 724 of the shaft-coupling unit 70 by means of an endless belt 84. Thus, the power of the motor 50 can be transmitted to the speed-reducing device 80 orderly through the shaft-coupling unit 70, the belt 84 and the time-marking belt pulley 83 and then, after speed reducing, transmitted to the power output terminal 82 to be output. Further, the power output terminal 82 of the speed-reducing device 80 is fitted thereon with an eccentric wheel 85 having a deflecting swing stud 851 protruding out vertically at an outer side.

The rod-connecting unit 90 includes a first, a second, a third, a fourth and a fifth connecting rod 91, 92, 93, 94, 95. The first connecting rod 91 has one end pivotally and vertically connected with the deflecting swing stud 851 of the eccentric wheel 85 of the speed-reducing device 80 and the other end pivotally and vertically connected with one end of the second connecting rod 92. The second connecting rod 92 has the other end pivotally and horizontally connected with one end of the third connecting rod 93, which has the other end pivotally and horizontally connected with an intermediate portion of the fourth connecting rod 94. Then, the fourth connecting rod 94 has its opposite ends respectively and pivotally connected with the pivotal lug 41 of the motor fixing base 40 and one end of the fifth connecting rod 95, which has the other end horizontally and pivotally connected with the pivotal lug 621 at the corresponding end of the upper holder 62 of the roller holder 60. Thus, when the eccentric wheel 85 of the speed-reducing device 80 is driven to rotate and actuate the first connecting rod 91 to move, the second, the third and the fourth connecting rod 92, 93, 94 will synchronously be actuated by the first connecting rod 91 to interact orderly. Simultaneously, the fourth connecting rod 94, which has one end pivotally connected with the pivotal lug 41 of the motor fixing base 40 together to serve as a rotary axis, will swing regularly and actuate the fifth connecting rod 95 to pull or push the upper holder 62 and the emery-tape roller 61 to swing to and fro biasly.

Figure 7:
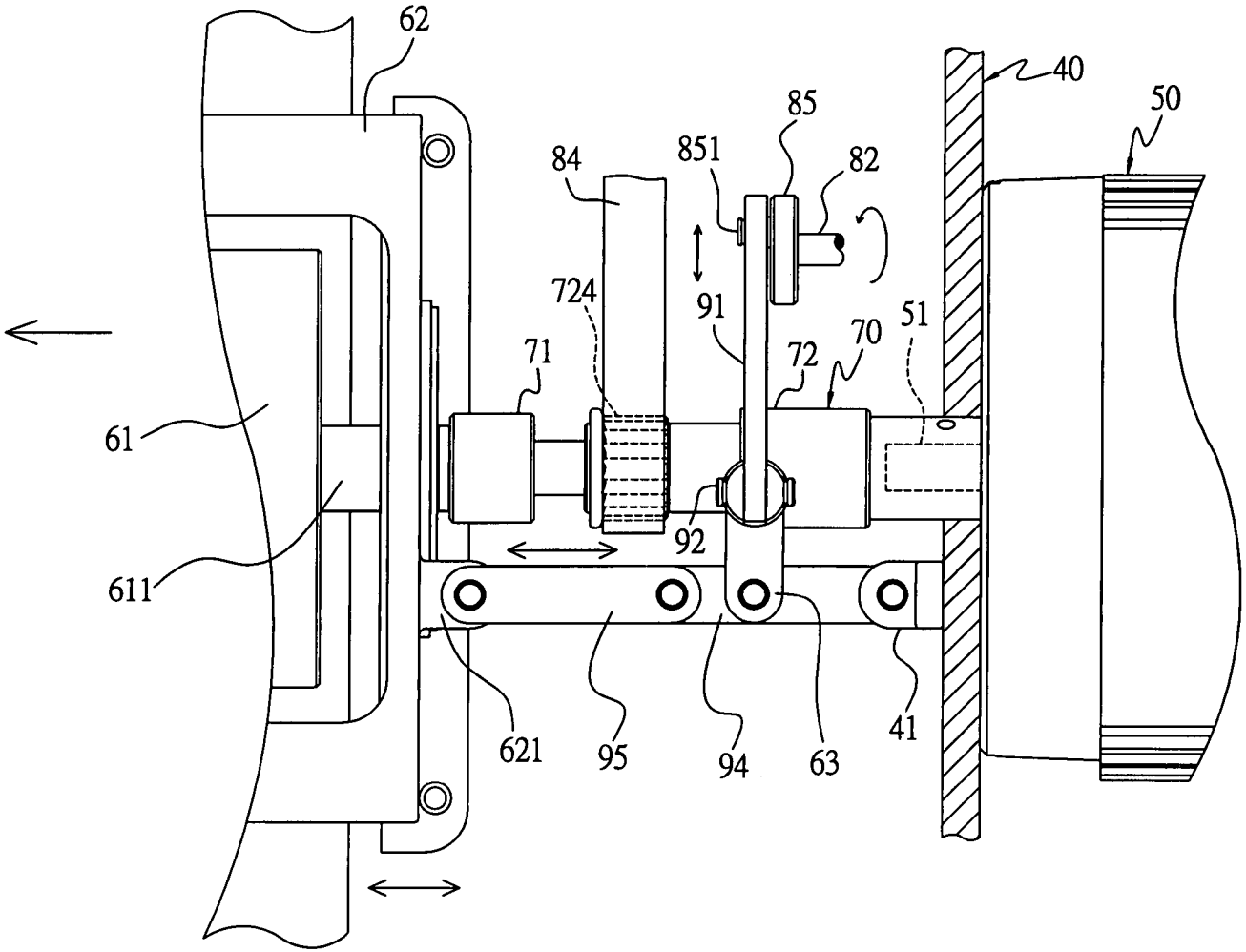
FIG. 7 is an upper view of the rod-connecting unit of the emery-polishing machine in an interacting condition in the present invention.

In operating, as shown in FIGS. 4 and 6, firstly, start the motor 50 to let its shaft 51 rotate and indirectly drive the emery-tape roller 61 to rotate through the shaft-coupling unit 70. At this time, the belt pulley 724 on the second shaft-coupling member 72 will drive the time-marking belt pulley 83 on the input terminal 81 of the speed-reducing device 80 to rotate by means of the belt 84 and power output by the motor 50 will indirectly be transmitted to the speed-reducing device 80. After rotating speed is reduced by the gear unit (not shown) in the speed-reducing device 80, the output power of the motor 50 is transmitted to the eccentric wheel 85 on the power output terminal 82 of the speed-reducing device 80. In the meantime, as shown in FIG. 7, the first connecting rod 91, which has one end pivotally connected with the eccentric wheel 85, will be driven by the eccentric wheel 85 to move biasly and actuate the second, the third and the fourth connecting rod 92, 93 and 94 to interact orderly. Synchronously, the fourth connecting rod 94, which has one end pivotally connected with the pivotal lug 41 of the motor fixing base 40 together to serve as a rotary axis, will swing regularly and actuate the fifth connecting rod 95 to pull or push the upper holder 62 of the roller holder 60 together with the emery-tape roller 61 to move to and fro biasly.

Figure 8:
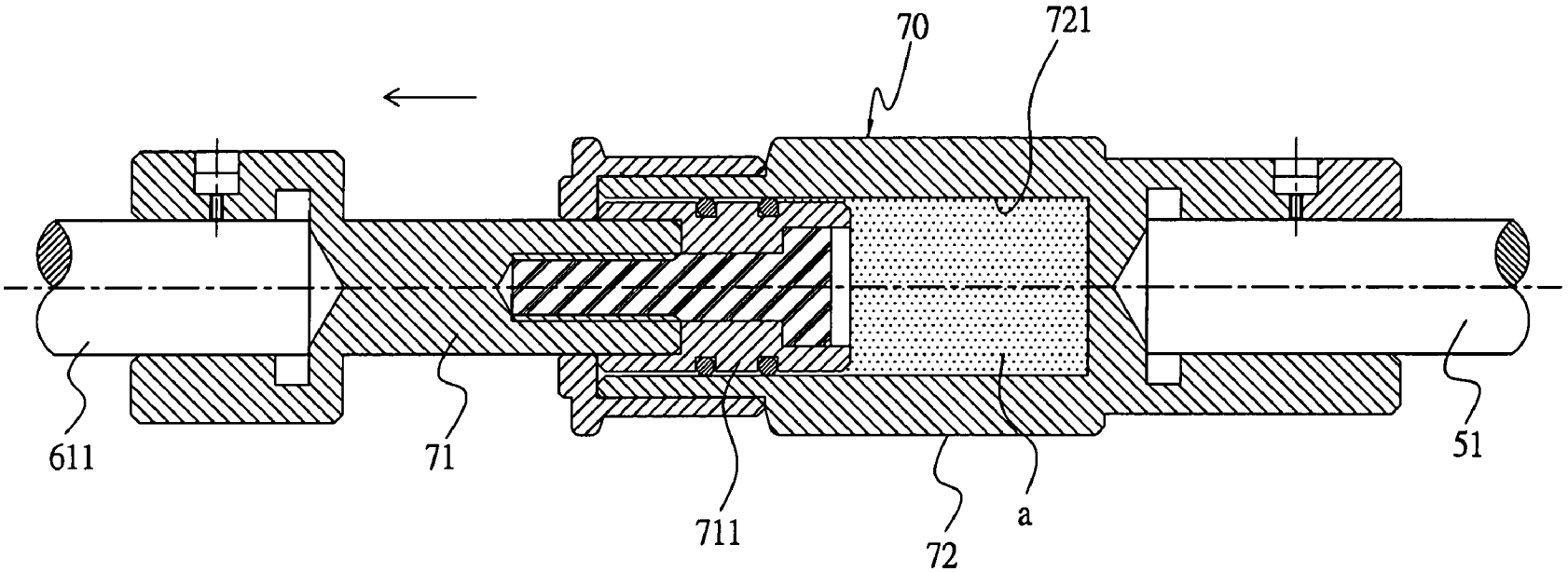
FIG. 8 is a side cross-sectional view of the shaft-coupling unit of the emery-polishing machine in buffering action in the present invention.

When the upper holder 62 together with the emery-tape roller 61 swings nearer to the motor fixing base 40, as shown in FIG. 8, the first shaft coupling member 71 together with the piston 711 will be pushed inward to compress the nitrogen (a) in the gas chamber 721 of the second shaft coupling member 72 and instantly the compressed nitrogen (a) will produce an increasingly reverse pushing force which is exactly able to absorb a vibration force produced by the emery-tape roller 61 when it swings inward and stops instantly at the terminus of its stroke. On the contrary, when the upper holder 62 and the emery-tape roller 61 swing far away from the motor fixing base 40, the first shaft-coupling member 71 together with the piston 711 will extend outward away from the gas chamber 721 of the second shaft-coupling member 72. At this time, the nitrogen (a) in the gas chamber 721 of the second shaft-coupling member 72 will produce an increasingly pulling force which is exactly able to absorb a vibration force produced by the emery-tape roller 61 when it swings outward and stops instantly at the terminus of its stroke, able to lower an oscillating force produced by the emery-tape roller 61 when it swings to and fro biasly and carry out abrading work smoothly.

As can be understood from the above description, this invention has the following advantages.

1. The emery-tape roller 61 is able to swing to and fro biasly; therefore, when carrying out wooden piece abrading, the emery-tape roller 61 has its contacting and abrading locations changed always to avoid concentrated abrasion, able to prevent a certain part of the emery-tape roller 61 from worn off fast to prolong its service life.

2. The emery-tape roller 61 is able to swing to and fro biasly; therefore, wood dust from the wooden work produced in the abrading process is not easy to be accumulated or adhered to a certain part of the emery-tape roller 61, able to elevate abrading effect and avoid deadlocking between the emery-tape roller and the wooden work being abraded.

3. The emery-tape roller 61 is able to swing to and fro biasly; therefore, a wooden work can be abraded not only in the forward and backward directions, but also in the sideward direction, able to have the surface of a wooden piece abraded completely and smoothly.

While the preferred embodiment of the invention has been described above, it will be recognized and understood that various modifications may be made therein and the appended claims are intended to cover all such modifications that may fall within the spirit and scope of the invention.

What is claimed is:

1. A reciprocating and deflecting swing device for a roller of a cylindrical emery-polishing machine comprising: a machine base, said machine base assembled with a conveyer on a topside, said machine base having one end provided with a motor fixing base having a motor installed on an outer side thereof, said motor fixing base having an inner side provided with a roller holder positioned above said conveyer, said roller holder having an emery-tape roller fitted axially in an interior thereof, said emery-tape roller driven by said motor to swing, wherein said roller holder comprising an upper holder and a lower holder, said lower holder connected with the inner side of said motor fixing base, said upper holder transversely engaged and positioned on said lower holder, said emery-tape roller axially fitted between the opposite ends of said upper holder:

a shaft-coupling unit consisting of a first shaft coupling member and a second shaft coupling member, said first and said second shaft coupling member movably fitted with each other and able to be elastically pulled outward or pushed inward a preset distance, said first shaft-coupling member having a free end connected with a shaft of said emery-tape roller, said second shaft-coupling member having a free end connected with a shaft of said motor, power output by said motor transmitted by said shaft-coupling unit to actuate said emery-tape roller to rotate, said second shaft-coupling member fixed with a belt pulley actuated by said second shaft-coupling member to rotate:

a speed-reducing device secured at a preset portion of the inner side of said motor fixing base, said speed-reducing device provided with a power input terminal and a power output terminal, said power input terminal fixed thereon with a time-marking belt pulley, said time-marking belt pulley connected to said belt pulley of said shaft-coupling unit by an endless belt, said output power of said motor transmitted to said speed-reducing device through said shaft-coupling unit, said speed-reducing device having its output terminal outputting said power after reducing speed, said power output terminal of said speed-reducing device assembled thereon with an eccentric wheel: and a rod-connecting unit consisting of plural connecting rods pivotally connected with one another, said connecting rods respectively and pivotally connected with the inner wall of said motor fixing base and the corresponding end of said upper holder of said roller holder and said eccentric wheel of said speed-reducing device, said rod-connecting unit actuated by said eccentric wheel to push and pull said upper holder of said roller holder and actuate said emery-tape roller to reciprocate toward and away from said motor base.

2. The reciprocating and deflecting swing device for the roller of a cylindrical emery-polishing machine as claimed in claim 1, wherein the free end of each of said first and said second shaft-coupling member is respectively bored with a shaft hole for said shaft of said emery-tape roller and said shaft of said motor to be respectively inserted and fixed therein, and said first shaft-coupling member has its inner end fixed with a piston to be closely clogged in a gas chamber provided at the inner end of said second shaft-coupling member, said gas chamber of said second shaft-coupling member filled therein with a proper amount of nitrogen, said first shaft-coupling member properly attracted inward by said nitrogen in said gas chamber when said first shaft-coupling member and said piston are actuated to move far away from said second shaft-coupling member, said first shaft-coupling member properly pushed outward by said nitrogen in said gas chamber when said first shaft-coupling member and said piston are actuated to move nearer to said second shaft-coupling member, said device having effects of buffering and able to lower noises and wear of the emery-tape roller.

3. The reciprocating deflecting swing device for the roller of a cylindrical emery-polishing machine as claimed in claim 1, wherein said eccentric wheel is fitted on said power output terminal of said speed-reducing device having a deflecting stud extending vertically at an outer side to be pivotally connected with an end of a corresponding connecting rod of said rod-connecting unit.

4. The reciprocating and deflecting swing device for the roller of a cylindrical emery-polishing machine as claimed in claim 1, wherein said rod-connecting unit consists of a first, a second, a third, a fourth and a fifth connecting rod, said first connecting rod having a first end pivotally and vertically connected with said eccentric wheel of said speed-reducing device and a second end pivotally and vertically connected with a first end of said second connecting rod, said second connecting rod having a second end pivotally and horizontally connected with a first end of said third connecting rod, said third connecting rod having a second end pivotally and horizontally connected with the an intermediate portion of said fourth connecting rod, said fourth connecting rod having opposite ends respectively and pivotally connected with the pivotal lug of said motor fixing base and a first end of said fifth connecting rod, said fifth connecting rod having a second end pivotally and horizontally connected with the pivotal lug at a corresponding end of said upper holder of said roller holder, said eccentric wheel of said speed-reducing device driven to actuate said first connecting rod to shift, said first connecting rod then actuating said second, said third and said fourth connecting rod to interact orderly, said fourth connecting rod having one end pivotally connected with said pivotal lug of said fixing base together to serve as a rotary axis, said fourth connecting rod driven to swing regularly and actuate said fifth connecting rod to pull or push said upper holder of said roller holder to reciprocate forwardly and backwardly.

* * * * *